United States Patent [19]

Taylor

[11] 3,967,409

[45] July 6, 1976

[54] MOTOR NOISE SIMULATOR FOR WHEELED TOYS

[75] Inventor: Beverly W. Taylor, Hermann, Mo.

[73] Assignee: Steven Manufacturing Company, Hermann, Mo.

[22] Filed: Nov. 24, 1975

[21] Appl. No.: 634,648

[52] U.S. Cl. ..... 46/111; 46/114; 46/175 R

[51] Int. Cl.[2] ..... A63H 5/00

[58] Field of Search ..... 46/111, 112, 114, 175

[56] References Cited

UNITED STATES PATENTS

| | | | |
|---|---|---|---|
| 2,603,035 | 7/1952 | Countryman et al. | 46/111 |
| 2,913,851 | 11/1959 | Jentzen | 46/114 |
| 3,233,361 | 2/1966 | Conaghan | 46/114 |
| 3,292,300 | 12/1966 | Lescher et al. | 46/114 |

*Primary Examiner*—Louis G. Mancene
*Assistant Examiner*—Robert F. Cutting
*Attorney, Agent, or Firm*—Polster and Polster

[57] ABSTRACT

In a wheeled toy having a frame and a wheel mounted for rotation with respect to the frame, two fixed resonators are mounted on the frame symmetrically on either side of a boss projecting from the frame, the resonators having a supporting platform, and a clopper is provided, including a pair of percussion units, a bridging piece between the percussion units and pawls projecting outboard of each of the percussion units, the percussion units engaging the supporting platforms of the resonators, and the bridging piece spanning between and being wedged between the surfaces and a facing surface of the boss, and a multiplicity of spaced trip means are carried by the wheel and positioned to engage both of the pawls when the wheel is rotating.

9 Claims, 7 Drawing Figures

MOTOR NOISE SIMULATOR FOR WHEELED TOYS

BACKGROUND OF THE INVENTION

This invention relates to noise-making devices for wheeled toys, and has particular but by no means exclusive application to toy power lawn mowers, in which an engine sound is to be emulated.

There are innumerable devices for creating noises in wheeled toys. The object of this invention is to provide such a noise-making assembly which is simple, easy to assemble, effective to produce the desired sound, and durable. Other objects will become apparent to those skilled in the art in the light of the following description and accompanying drawing.

SUMMARY OF THE INVENTION

In accordance with this invention, generally stated, in a wheeled toy having a frame member and a wheel mounted for rotation with respect to the frame member and closely adjacent thereto, a boss is provided on the frame member, projecting in a direction toward the wheel; two fixed resonators are fixedly mounted on the frame member symmetrically on either side of the boss, the resonators having a supporting platform; a clopper, including a pair of percussion units, a bridging piece between the percussion units and pawls projecting outboard of each of the percussion units is mounted in such a way that the percussion units engage the supporting platforms of the resonators and the bridging piece is wedged between the surfaces and a facing surface of the boss, and a multiplicity of spaced trip means is carried by the wheel and positioned to engage both of the pawls as the wheel is rotated. In the preferred embodiment, the boss and the resonators are made integral with the frame member, the resonators include bowl-shaped sections, the percussion units include cups each with an open mouth facing a resonator and all of the clopper is made of one piece of flexible plastic, the pawls having an integral hinge so arranged that one of the percussive units operates to produce noise when the wheel is rotated in one direction and the other, when the wheel is rotated in the opposite direction. Further, in the preferred embodiment the boss includes an axle integral with it, bifurcated at its outer end and provided with a radially outwardly projecting shoulder, and the wheel is provided with a hub with an axle-bearing passage of a length to fit between the axle shoulders and a shoulder on a shank of the boss.

DESCRIPTION OF THE PREFERRED EMBODIMENT

Figure 1:
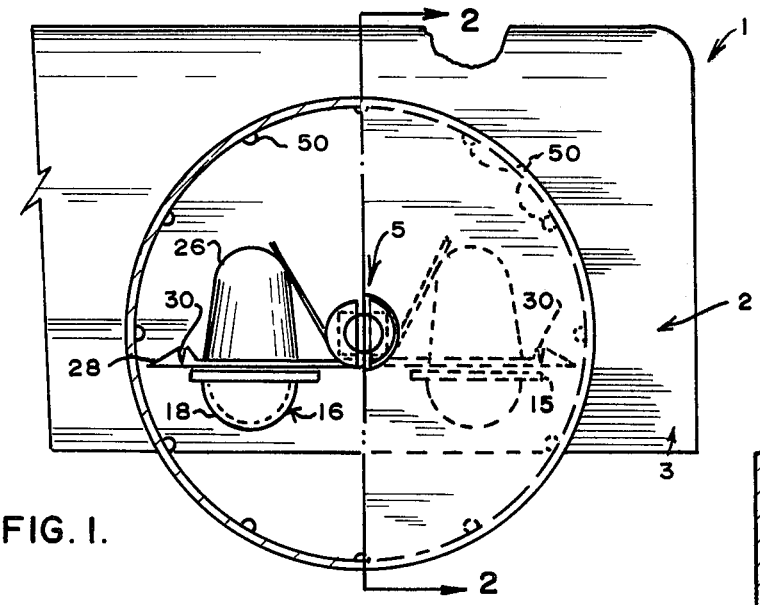
FIG. 1 is a view in side elevation, partly in section, of one embodiment of noise-making assembly of this invention.
Figure 3:
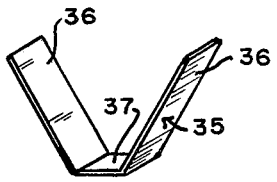
FIG. 3 is a view in perspective of a spring element.
Figure 4:
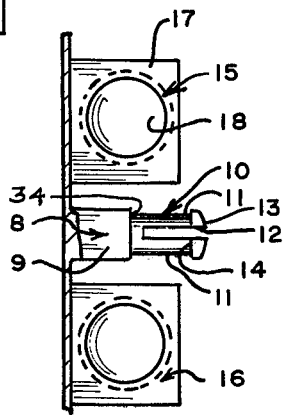
FIG. 4 is a sectional view taken along the line 4—4 of FIG. 2.

Referring now to the drawings for one illustrative embodiment of the wheeled toy assembly, reference numeral 1 indicates a wheeled toy, in this embodiment, a toy lawn mower, having a frame or housing 2 defined in part by a frame member in the form of a generally vertical flat wall 3, wheels, including a special wheel 4, and a noise-making assembly 5.

In the embodiment shown, the housing 2 is made of plastic, and a boss 8 is molded integrally with the wall 3. The boss 8 has a square shank 9, and a bifurcated axle 10 projecting outboardly perpendicularly from the plane of the outer surface of the wall 3. The axle 10 is circular in cross section, and is smaller in diameter than the diagonal distance across the square shank, to produce a shank shoulder 34. The axle 10 has bearing surfaces 11 interrupted by a chordal slot 12, and a coned head 13 between which and the bearing surfaces 11, are retaining shoulders 14.

Also molded integrally with the wall 3 and positioned symmetrically on either side of the boss 8, are resonators 15 and 16. Each of the resonators 15 and 16 has a platform area 17 and a bowl or bowl-shaped section 18. In the embodiment shown, the platform 17 is wide, forming a substantial bearing surface. The bearing surfaces of the resonator platforms are separated but substantially co-planar, the common plane being spaced away from a facing surface of the shank 9 a short distance.

Figure 6:
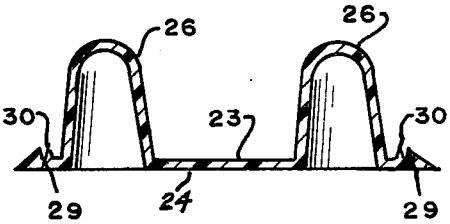
FIG. 6 is a sectional view taken along the line 6—6 of FIG. 5.
Figure 7:
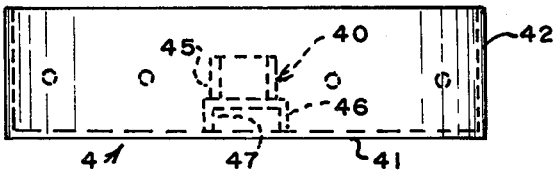
FIG. 7 is a top plan view of a wheel element of this invention.

A unitary clopper 20, with percussion units 22 connected by a bridging piece 23, is mounted between the shank 9 and the resonator platforms 17. The clopper bridging piece joins border areas 25 of the percussion units, each of which also includes a cup 26. The clopper has a substantially flat undersurface 24, through which open mouths of the cups 26 extend, as shown in FIG. 6. Pawls 27 are integral with the border 25, and project outboardly in opposite directions at two ends of the clopper.

Each of the pawls has a finger 28 and a stop 30, connected by an integral hinge 29. A narrow V, shown exageratedly wide for clarity in the drawings, terminating near the surface 24, separates the finger 28 and the stop 30.

The mouths of the resonator bowls 18 and the clopper cups 26 coincide when the clopper is mounted.

Figure 2:
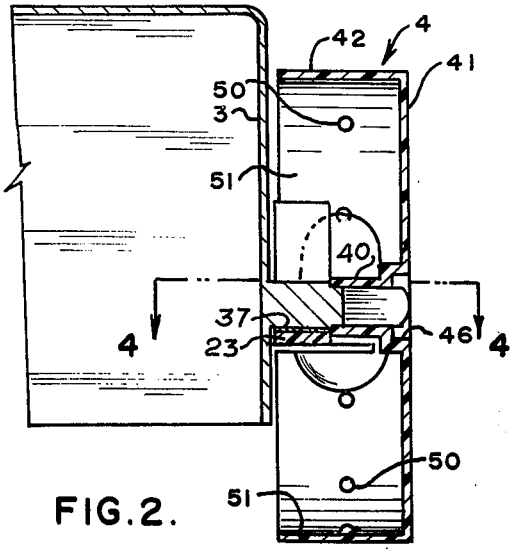
FIG. 2 is a sectional view taken along the line 2—2 of FIG. 1.
Figure 5:
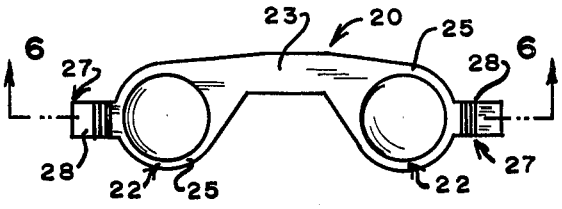
FIG. 5 is a top plan view of a clopper element.

In this embodiment, auxiliary spring 35, with a spring bridging section 37 just long enough to accommodate the shank 9, and arms 36 extending divergently from the bridging section 37, is mounted between the bridging piece of the clopper and the flat facing surface of the square shank 9, as shown in FIGS. 1 and 2. The arms 36 bear on an upper surface of the cups 26, biasing the percussion units toward the resonators.

The wheel 4 of this embodiment is dish-shaped, with a hub 40, a web 41 integral with the hub, and a rim flange 42 integral with and extending perpendicularly to the web 41.

The hub has a sleeve 45, defining an axle bearing passage, and a step 46 between the web 41 and the sleeve 45, to provide a well 47. The well 47 receives the axle head 13, and the shoulders 14, caging the hub sleeve 45 between the shoulders 14 and the shank shoulder 34.

On an inside surface 51 of the rim flange 42 of the wheel, trip means, in the form of aligned inwardly radially projecting projections 50, are molded integrally with the flange.

In assembling the wheeled toy of this invention, the spring 35 can be placed on the bridge 23 of the clopper 20, and both pushed beneath the square shank 9 of the boss 8, the border 25 engaging the supporting platform 17 of the resonators. Preferably, the thickness of the bridge piece 23 and the spring 37 and the spacing of the plane of the platforms 17 from the shank are such as to place the bridge piece 23 under slight compressive force, to hold the border 25 in close engagement with the support platform 17, but without rocking the border areas away from the platforms.

The wheel 4 is then simply forced over the head 13 of the axle 10, the resilience of the material from which the axle is made permitting the bifurcated part of the axle to move inwardly, until the outer surface of the stepped part of the well 47 clears the shoulder 14, when the head springs out, caging the wheel hub sleeve between the shoulders 14 and the shank shoulder 34. The dimensions of the sleeve are such as to permit the wheel to revolve freely, but to limit axial play closely.

As the toy is pushed in a direction toward the right as viewed in FIG. 1, the wheel will rotate clockwise. The projections 50 extend inwardly radially sufficiently to engage the fingers 28 of the pawls 27. As the projections on the right side of the wheel, as viewed in FIG. 1, pass the finger 28 of that pawl, the finger merely hinges down until the projection clears, without moving the rest of the percussion unit. On the left side, as viewed in FIG. 1, when a projection 50 engages the finger 28, the finger hinges only slightly, until it meets the stop 30, and thereafter lifts the percussive unit against the natural bias of the flexible material of which the bridging piece and border are made, and, in the embodiment shown, against the bias of the spring arm 36, until the projection clears the finger, when the percussive unit snaps back on top of the resonator 16, causing a loud clop.

It can be seen that if the toy is pulled the other direction, the opposite action is produced, the percussive unit over the resonator 16 remaining stationary, and the percussive unit over the resonator 15 moving up and snapping back to clop.

It can be appreciated that the material from which the clopper is made can be such as to make the use of the spring 35 unnecessary. However, the use of the spring 35 permits the use of a greater variety of materials, and different gauges of material.

It can be seen that the construction of this invention permits mounting of the noise making assembly on either side of the toy, and the use of the same kind of boss and wheel for any or all wheel assemblies, with or without the noise-making assembly.

Numerous variations in the construction of the wheeled toy assembly of this invention, within the scope of the appended claims, will occur to those skilled in the art. More than one wheel can be equipped with the noise-making assembly. The axle can be differently slotted, or it can be made integral with the wheel and inserted through a bore in the boss, with a snap-acting bifurcated section, in a reversal of parts. The trip means 50 can be differently constructed, as for example by running projections substantially the axial length of the flange 42, so that they take the form of lands or bars separated by grooves, and they can be differently spaced. They can be formed on the inside surface of the web, preferably near the rim, if the pawls are redirected. The support platform area 17 can be reduced or increased, as can the border area 25. The shape of the shank can be altered, or a depending lip provided to hold the clopper or spring against axial movement, although in the preferred embodiment the end of the wheel hub sleeve can serve that purpose if it becomes necessary. While in the preferred embodiment the resonator platforms are co-planar, they can be angled to accommodate the bending of the clopper in response to the movement between the shank and platforms. The resonator bowls can be varied in size and shape, and may even be eliminated, the resonator platforms being made continuously planar, but the clopper in such case must be made of rather stiff plastic to produce a distinctly audible sound, and the preferred construction described has distinct advantages. The invention can be applied to toys which are not wheeled in the usual sense but which do have rotating parts. For example, in a toy chain saw, a revolving wheel or disc driven by a spring or by hand, for example, can be provided with trip means projecting either radially or axially, as has been suggested heretofore, to trip a clopper mounted on an element of or carried by a frame relative to the rotating wheel or disc. To this extent, the term "wheeled" as used in the claims, embraces a toy in which a rotating wheel or disc is employed, whether or not the toy is designed to be supported by the wheel or wheels which actuate the clopper. These variations are merely illustrative.

Having thus described the invention, what is claimed and desired to be secured by Letters Patent is:

1. In a wheeled toy having a frame member and a wheel mounted for rotation with respect to said frame member closely adjacent said frame member the improvement comprising a boss on said frame member projecting from said member in a direction toward said wheel; two fixed resonators fixedly mounted on said frame symmetrically on either side of said boss, said resonators having a supporting platform; a clopper including a pair of percussion units, a bridging piece between said percussion units, and pawls projecting outboard of each of said percussion units, said percussion units engaging the supporting platforms of said resonators and said bridging piece spanning therebetween and being wedged between said surfaces and a facing surface of said boss, and a multiplicity of spaced trip means carried by said wheel and positioned to engage both of said pawls as said wheel is rotated.

2. The improvement of claim 1 wherein the resonators include bowl-shaped sections.

3. The improvement of claim 1 wherein each of the percussion units has a cup with an open mouth facing a resonator.

4. The improvement of claim 1 wherein the clopper is a one-piece unit of flexible plastic.

5. The improvement of claim 1 wherein the boss has an axle projecting from it on which said wheel is journaled for rotation.

6. The improvement of claim 1 wherein the wheel has a web and an annular rim flange extending from said web toward said frame, and said trip means comprise spaced projections extending radially inwardly from an inner surface of the said rim flange.

7. The improvement of claim 1 wherein the frame member, boss and resonators are unitary.

8. The improvement of claim 1 including a spring mounted between the bridging piece and the boss, engaging the percussion units and biasing them toward the resonators.

9. The improvement of claim 5 wherein the boss has a shoulder between the frame member and the axle, the axle is bifurcated at its outer end and has radially outwardly projecting shoulders and said wheel has a hub with an axle bearing passage of a length to fit between said boss shoulder and said axle shoulders.

* * * * *